US011007657B2

(12) United States Patent
Dixon

(10) Patent No.: US 11,007,657 B2
(45) Date of Patent: May 18, 2021

(54) TOOL HAVING AN ANGLED HANDLE

(71) Applicant: Cleveland Dixon, Lothian, MD (US)

(72) Inventor: Cleveland Dixon, Lothian, MD (US)

( * ) Notice: Subject to any disclaimer, the term of this patent is extended or adjusted under 35 U.S.C. 154(b) by 329 days.

(21) Appl. No.: 14/288,804

(22) Filed: May 28, 2014

(65) Prior Publication Data

US 2015/0343651 A1 Dec. 3, 2015

(51) Int. Cl.
*B26B 3/00* (2006.01)

(52) U.S. Cl.
CPC ..... *B26B 3/00* (2013.01)

(58) Field of Classification Search
CPC ..... B26B 3/00; B26B 1/00
USPC ..... 30/314, 294, 280
See application file for complete search history.

(56) References Cited

U.S. PATENT DOCUMENTS 691,237 A * 1/1902 Buell ..... B23D 51/01 30/520
847,815 A * 3/1907 Soresina ..... B26B 29/02 30/295
1,102,918 A * 7/1914 Hector ..... B23D 51/125 30/506
1,810,349 A * 6/1931 Green ..... B23D 51/125 30/513
2,214,827 A * 9/1940 Boe ..... B23D 61/123 83/855
2,467,327 A * 4/1949 McKee ..... A01G 3/06 172/13
2,710,032 A * 6/1955 Clark ..... A22B 5/205 30/514
2,725,911 A * 12/1955 Glenn ..... B23D 51/125 30/506
2,849,039 A * 8/1958 Dreier ..... B23D 51/10 30/524
3,521,353 A * 7/1970 Fabyan ..... B23D 49/14 7/148
4,117,593 A * 10/1978 Piligrino ..... B26B 3/03 30/314
4,202,095 A * 5/1980 Gingras ..... B26B 3/02 30/165
4,442,570 A * 4/1984 Lynn ..... A22C 29/024 30/314
D318,208 S * 7/1991 Cosio ..... D7/649
5,113,587 A * 5/1992 Loomis ..... B26B 3/00 30/125
5,275,068 A * 1/1994 Wrench ..... A01B 1/22 30/296.1
D362,375 S * 9/1995 Kramer ..... B26B 29/06 D22/118

(Continued)

OTHER PUBLICATIONS

Amazon.com product information page for Sammons Preston Rocker Knife with Plastic Handle, https://www.amazon.com/Sammons-Preston-Disabled-Equipment-Handicapped/dp/B06XRGDYXD/ref=cm_cr_arp_d_product_top?ie=UTF8&th=1 (Year: 2013).*

(Continued)

*Primary Examiner* — Andrea L Wellington
*Assistant Examiner* — Fernando A Ayala

(57) ABSTRACT

A tool, such as a knife or a surgical instrument, is disclosed having a sharp edge, a first end and a second end. A connecting member connects the second end of the member with a handle, wherein the connecting member connects the handle at a fixed angle between 24° and 46° relative to the sharp edge of the member.

13 Claims, 7 Drawing Sheets

(56) References Cited

U.S. PATENT DOCUMENTS

| | | | | | |
|---|---|---|---|---|---|
| 5,513,587 | A * | 5/1996 | Takada | D06F 47/00 | 112/165 |
| 5,518,895 | A * | 5/1996 | Thorpe | C12M 41/26 | 435/287.5 |
| 5,581,895 | A * | 12/1996 | Jeffcoat | B26B 1/02 | 30/294 |
| 5,669,142 | A * | 9/1997 | Beckers | B26B 3/08 | 30/314 |
| 8,312,632 | B2 * | 11/2012 | Rowlay | B23D 51/10 | 30/329 |
| 2002/0046467 | A1 * | 4/2002 | Gray | A22C 17/0013 | 30/304 |
| 2004/0093741 | A1 * | 5/2004 | Holler | B26B 29/02 | 30/314 |
| 2005/0097759 | A1 * | 5/2005 | Igarashi | B26B 3/00 | 30/277.4 |
| 2007/0056427 | A1 * | 3/2007 | Males | B23D 61/121 | 83/835 |
| 2007/0137047 | A1 * | 6/2007 | Kim | B26B 1/046 | 30/161 |
| 2008/0295339 | A1 * | 12/2008 | Lipscomb | B26B 13/22 | 30/194 |
| 2014/0068950 | A1 * | 3/2014 | Taylor | B28D 1/183 | 30/172 |
| 2016/0067803 | A1 * | 3/2016 | Kohl | B26B 1/044 | 30/161 |

OTHER PUBLICATIONS

The Sausage Maker boning knife product page, sausagemaker.com, https://www.sausagemaker.com/Safety-T-6-Boning-Knife-p/13-1030.htm (Year: UNKN).*

* cited by examiner

TOOL HAVING AN ANGLED HANDLE

FIELD OF THE INVENTION

The present disclosure relates to tools and more specifically to a tool such as a knife having a handle that is connected to a knife blade via a connecting member in such a manner as to fix the handle at a 25-45° angle relative to a horizontal position of a sharp edge of the knife.

BACKGROUND OF THE INVENTION

FIG. 1 illustrates a general purpose knife 100. As is commonly known, the knife has a handle 106 connected to a blade 102 having a sharp edge 104 used for cutting. There are multiple problems when using knife 100.

A first problem is that typically a user of the knife will be standing up when cutting items with a knife. In this position, the position of the handle is not ergonomically correct. When a user is cutting with the knife 100, after just a few cuts, unusual pressure can be experienced in the wrist of the user quickly causing the knife to be difficult to hold.

Because of the position of handle 106, the user can also lose control of the knife after even just several cuts, and due to the unusual pressure on the wrist, the knife can be difficult to hold.

In addition, depending on the resting position of the knife, it can be difficult or potentially dangerous to pick up the knife in the natural position prior to holding the knife using handle 106.

Finally, if the knife is used for cutting while being moved in a horizontal position, it can be difficult in that the user would have to hold tightly to the handle 106 to pull the knife through an item that is being cut. This renders it unnecessarily difficult to use a standard knife.

SUMMARY

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

The present disclosure addresses the issues identified above as well as others by providing a tool that includes a member such as a knife blade having a sharp edge along a horizontal surface, a first end and a second end. A connecting member connects the second edge of the member with a handle such that the handle is fixed at an angle between 24° and 46° relative to the horizontal surface of the sharp edge of the member. In this manner, the ability to pick up and use the tool can be performed in a more ergonomically position with respect to a user standing at a counter or a table and cutting items using such a tool. The handle will provide an improved ability of the user to be able to make numerous cuts with the knife without resulting in awkward pressure on the wrist, thus tiring the user unnecessarily.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only exemplary embodiments of the invention and are not therefore to be considered to be limiting of its scope, the invention will be described and explained with additional specificity and detail through the use of the accompanying drawings in which.

DETAILED DESCRIPTION

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

Figure 1:
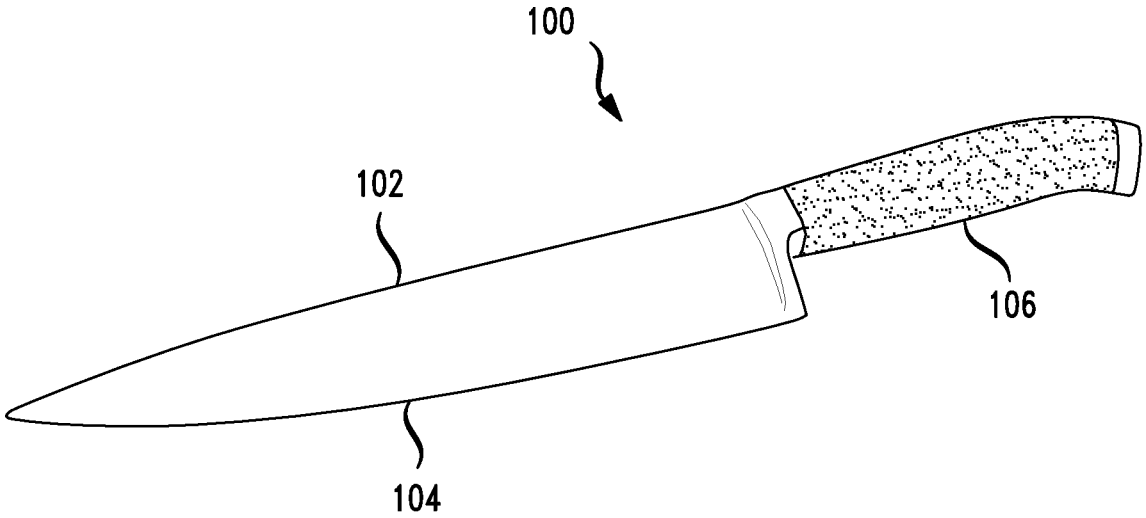
FIG. 1 PRIOR ART
FIG. 1 illustrates a prior art knife.
Figure 2:
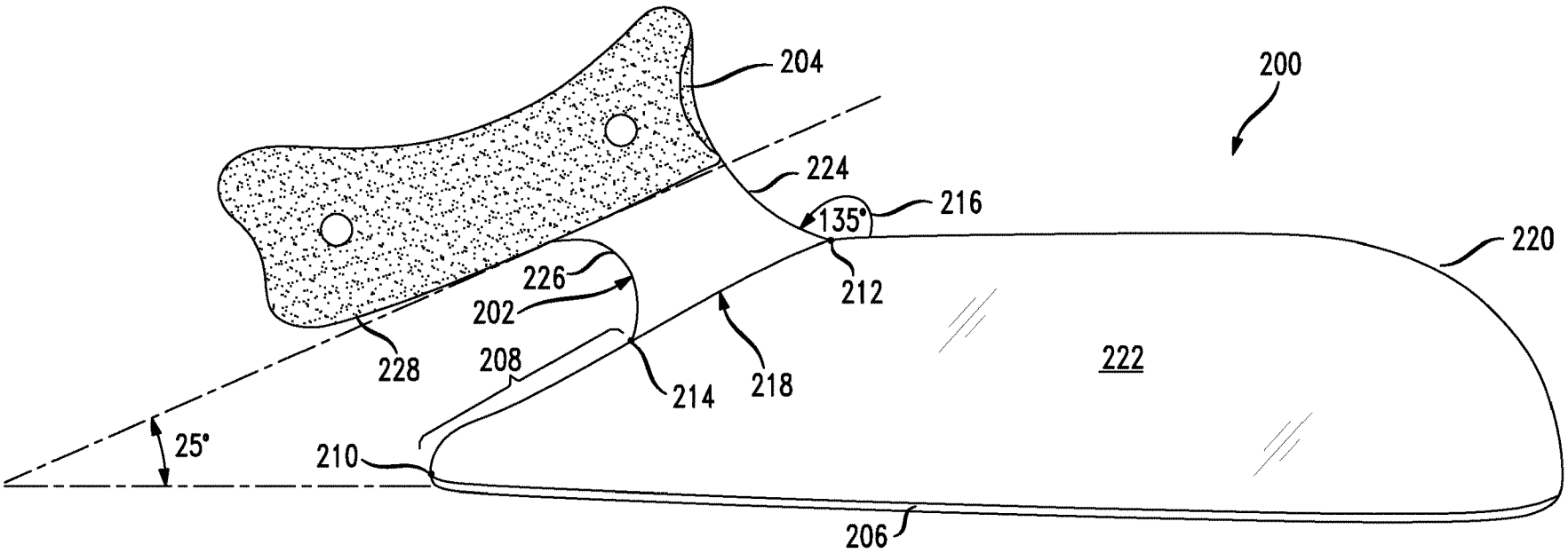
FIG. 2 illustrates a first embodiment of this disclosure.

FIG. 2 illustrates a first embodiment of this disclosure. A tool 200, such as a knife, has several features. The tool 200 has a member with a flat first metal portion 222. This can generally be considered having a structure typical of a knife blade. The member 222 has a first edge 220 and a second edge 218. Edge 206 is preferably a sharp edge of the member 222 which can be used for cutting. A connecting member 202 connects the second edge 218 of the member 222 with a handle 204.

In this first embodiment, a position of the connecting member 202 is shown in a particular location along edge 218. Edge 218 is generally defined in the first embodiment as the edge of member 222 between point 210, which essentially is the position at which the sharp edge 206 ends and along a horizontal line (when the tool is in a horizontal position) and a vertical or oblique edge 218, and position 212 which represents an ending position of the second edge 218. Connecting member 202 can also have a first edge 226 and a second edge 224. In this embodiment, edge 224 is shown to have an angle relative to a horizontal position defined along sharp surface or edge 206 of approximately 135° 216. This angle of course can be also part of a broader range such as between 90° and 180° relative to a horizontal position. It is noted that edge 224, however, is extending from a position of the member 222 generally at position 212. Edge 226 of connecting member 202 is shown as being a distance 208 from the most extended position of the second edge 218 of member 222 at position 214, which is a starting point for the extension of edge 226 of connecting member 202. Position 214 can essentially be in any position along edge 218. However, in this first embodiment, it is preferable that position 214 is generally in a central position between point 210 and 212. In another embodiment, distance 208 is one inch or greater.

The positioning of connecting member 202 enables several beneficial features. First, it enables the handle 204 to be positioned at an angle relative to the horizontal surface associated with edge 206 of between 25° and 45°. FIG. 2 shows the angle at an exemplary 25°. The structure of handle 204 enables a user to hold the handle and have at least some fingers wrap around the handle along surface 228, which can enable a simple and comfortable holding position for tool 200.

While position 210 is considered as a most extended position of the second end 218, position 212 can be considered a least extended position of the second end or edge 218. In one embodiment, the tool 200 has an overall length of 10 to 11 inches and an overall height of 3½ to 5½ inches. While this is a preferable size, any width and height can be applied and encompassed within the scope of this disclosure.

Figure 3:
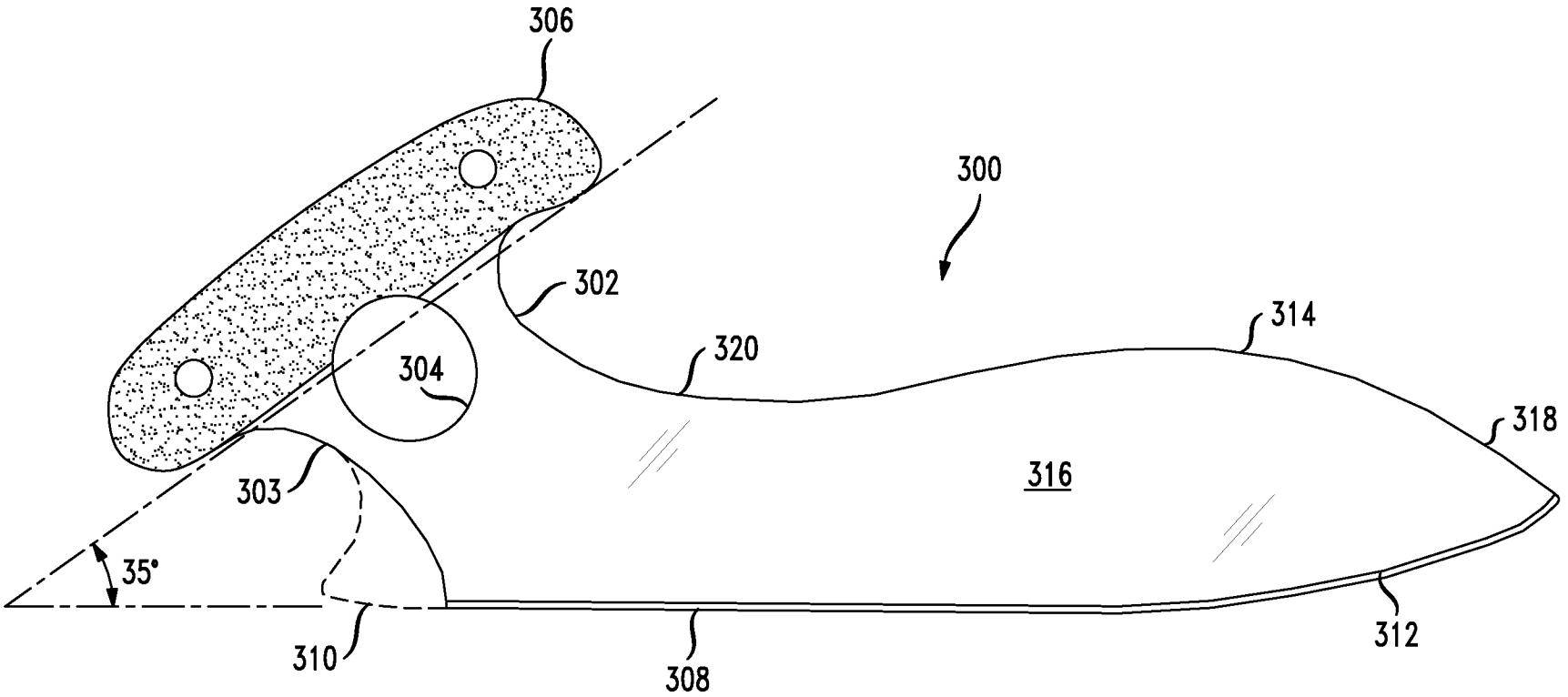
FIG. 3 illustrates a second embodiment of this disclosure.

FIG. 3 illustrates a second embodiment of the present disclosure. FIG. 3 illustrates a tool 300, which includes a member 316 having a first end 318 and a second end generally positioned at 320. When tool 300 is a knife, edge 308 is typically a sharpened edge that has a horizontal surface for a majority of the length of member 316 and which can angle upward at generally position 312. A top edge 314 of member 316 can also be angled as shown or horizontal. A connecting member 302 connects member 316 generally at position 320 with a handle 306. The connecting member in FIG. 3 also has two components in portion 302 and in portion 303. An opening 304 enables a user to put one or two fingers through the opening 304 for ease of holding the handle 306. A diameter of the opening 304 and any other opening disclosed herein can be of any range that is comfortable for inserting one or more fingers, but is typically above 0.5 inches. The second end of member 316 at point 320 can also have an optional shape shown by feature 310 in which the shape along the sharp edge 308 that connects with connecting member 303 can take on a number of different shapes.

As is shown, handle 306 is supported and held by connecting member 302/303 in such a way as to be positioned at approximately 35° relative to a horizontal position defined by surface 308 of member 316. As noted above, the particular angle of handle 306 can be anywhere between and including 25° and 45° relative to a line defined by surface 308. It is also noted that connecting members 302/303 fix the handle 306 in an unchanging position for strength and convenience in handling tool 300 by a user. In one example embodiment, a width of tool 300 can be between 10 and 11 inches wide and between 3 and 5 inches tall. However, any other width and height may also be within the scope of this disclosure.

Figure 4:
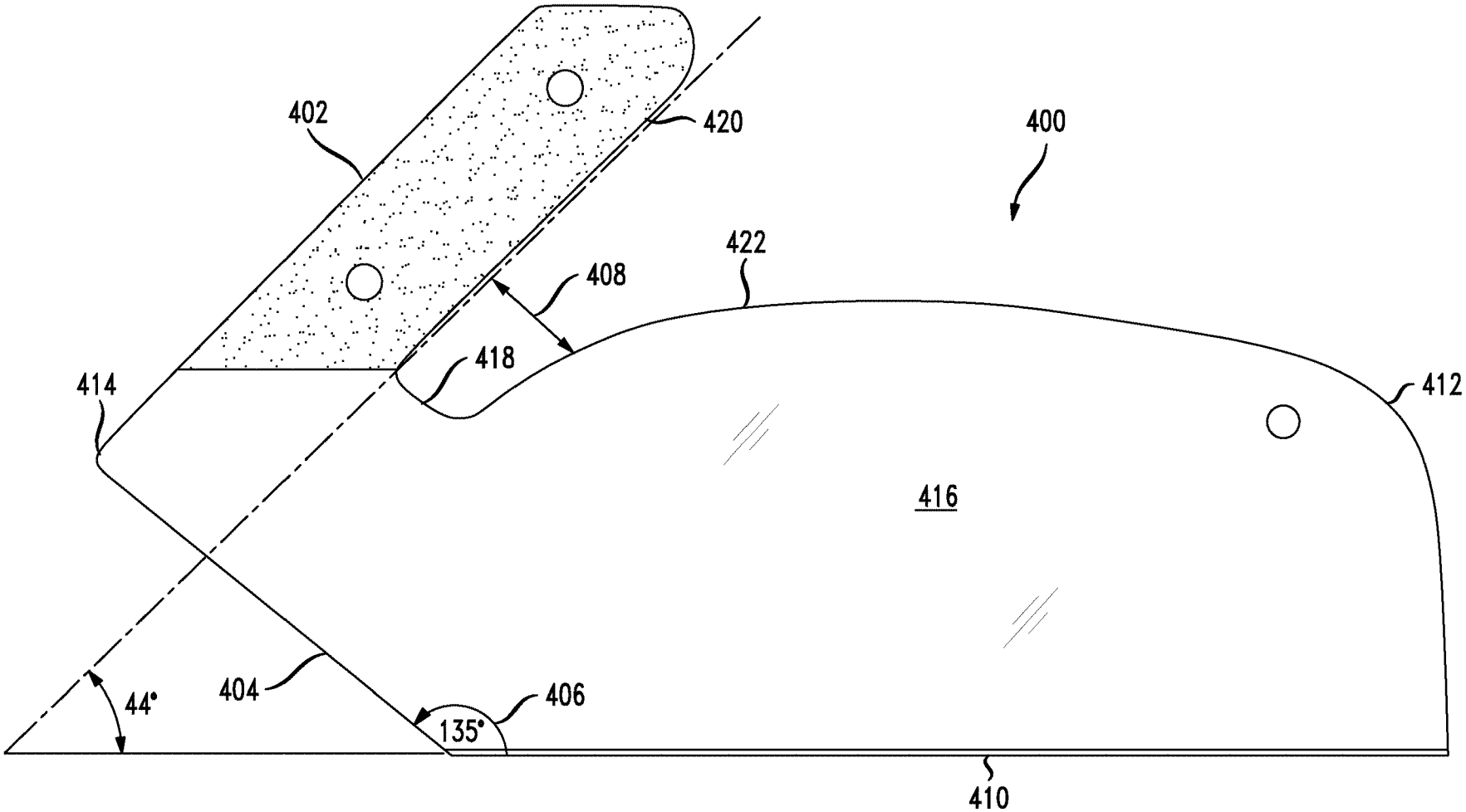
FIG. 4 illustrates a third embodiment of this disclosure.

FIG. 4 illustrates a third embodiment which is a tool 400 having yet another particular structure. Member 416 has a first edge 412 and a second edge 414 at either end of the member 416. A lower edge 410 is typically the sharp edge which is used for cutting.

In this embodiment, the second edge 404 is shown to extend from a left portion of edge 410 at an angle approximately 135° 406 relative to a line defined by edge 410. Of course, this angle can range from 90° to 170°.

According to this embodiment, the handle 402 is connected to member 416 by a connecting member 418. Connecting member 418 is configured in such a way as to provide an edge 420 that enables a user to hold the handle 402 with enough distance between the edge 420 of the handle 402 and a top edge 422 of the member 416. This distance is shown as distance 408 in FIG. 4. The connecting member 418 may also have an edge 414 which can be of the shape shown in FIG. 4 or any other shape that enables a fixed position of the handle 402 relative to the member 416.

As is shown, a preferable angle for handle 402 relative to a horizontal line defined by edge 410 is 44°. However, the angle of handle 402 can be in the range between and including 25° to 55°. In the example embodiment of tool 400, the overall width of the tool may be between 11 and 12 inches wide and 6 to 7 inches tall. However, any width and height may be considered as within the scope of this disclosure.

Figure 5:
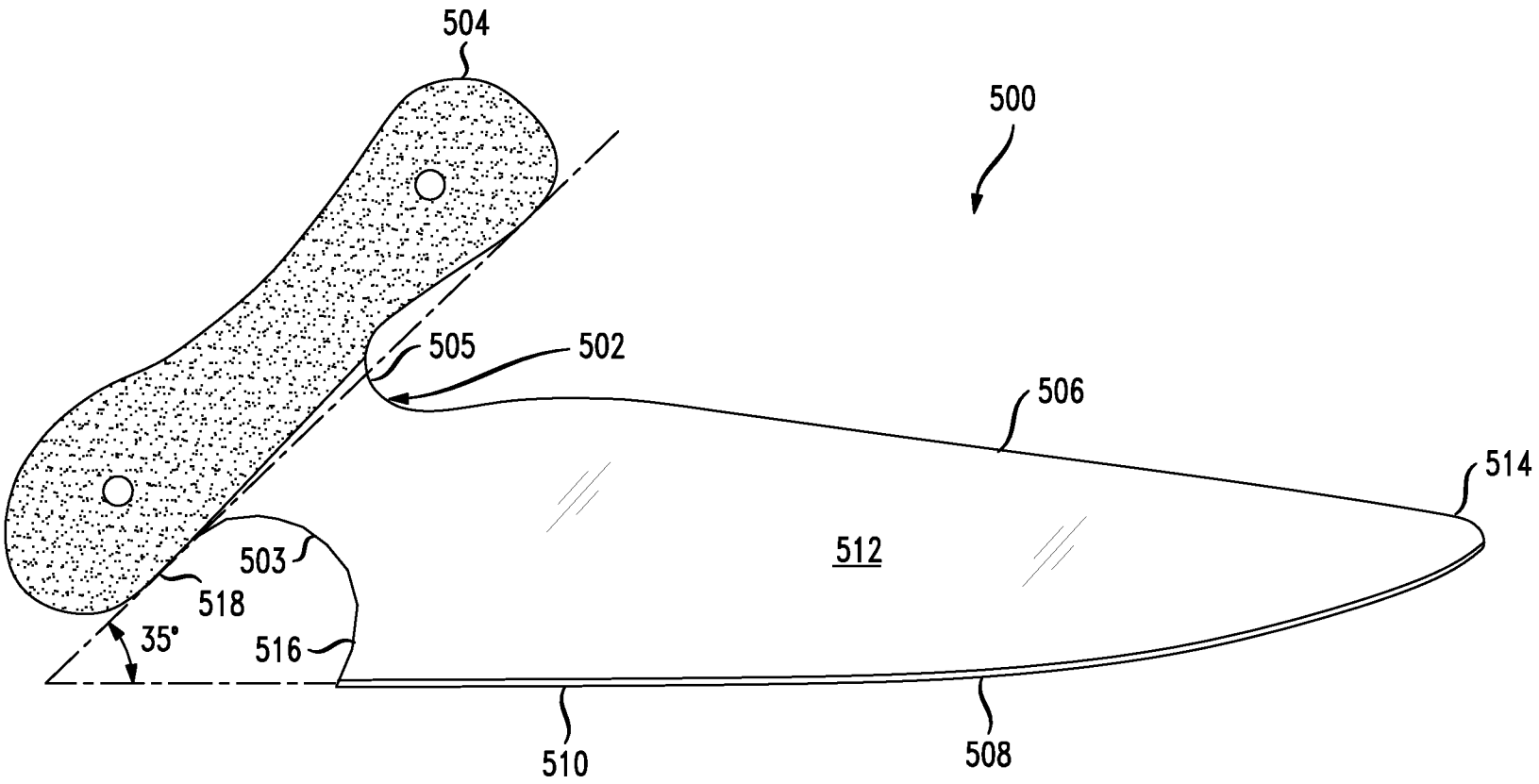
FIG. 5 illustrates a fourth embodiment of the disclosure.

FIG. 5 illustrates a fourth embodiment of this disclosure. The tool 500 shown in FIG. 5 includes a member 512, which has a lower surface 510 which is typically a sharpened surface. Surface 510 extends along in generally a horizontal direction and may connect with an angled surface 508 which also may be sharpened. A first edge 514 defines an end of member 512 and a second edge 516 can represent the other edge of the main member 512. A top surface 506 can be structured in any shape and is typically not sharpened. A top edge 505 and a bottom edge 503 define the structure of the connecting member 502 that connects the second edge 516 of member 512 with the handle 504. As can be seen, the connecting member 502 connects the member 512 to the handle 504 such that the handle 504 is positioned to be at 35° relative to a horizontal line defined by surface 510. It is noted that member 502 can also be structured such that handle 504 might be configured such that an angle along the handle can be anywhere between and including 25° and 45° relative to a horizontal line or a table surface. Handle 504 can also have a configuration such that an upper portion of the handle 520 extends further from edge 505 relative to the distance that a lower portion 518 of the handle extends from edge 503. In this regard, a user may be able to hold handle 504 in such a way that at least one or more fingers may be able to wrap around the upper portion of the handle 520 for ease of use and comfort.

It is noted that tool 500 is preferable to be between 11 and 12 inches wide and between 4 and 6 inches tall. However, any width and height would be considered within the scope of this disclosure.

Figure 6:
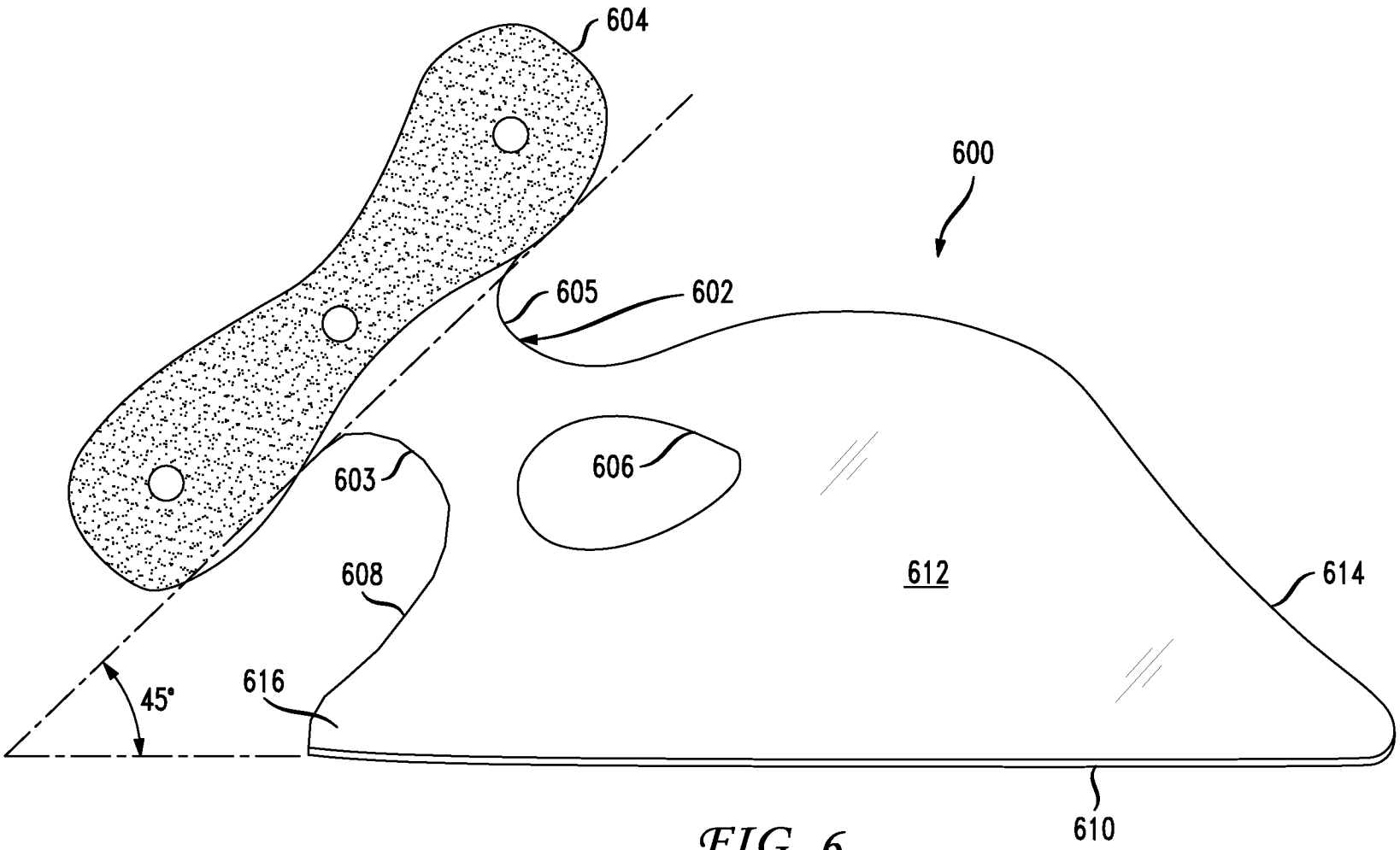
FIG. 6 illustrates a fifth embodiment of the disclosure.

FIG. 6 illustrates tool 600, which has a member 612 having a sharpened edge 610, a first edge 614, and a second edge 608. An opening 606 has a diameter of preferably at least 0.5 inches up to 3 inches. The opening 606 can be positioned anywhere within member 612. It is noted that connecting member 602 has an edge 603 and an edge 605, which define the member and its shape as it extends from the second edge 608 of member 612 to connect the member 612 to the handle 604. It is noted that connecting member 602 is generally shown as being connected to member 612 at a position approximately 2 inches along edge 608 from point 616, which defines a most extended portion of edge 608 away from a central portion of member 612. Thus, it can be appreciated that connecting member 602 is positioned at a relatively high portion along edge 608. This position as well as the handle 604 enables a user to easily retrieve and hold the tool 600 for cutting.

A preferable overall length of tool 600 is between 10 and 12 inches long and a preferable height between 6 and 7 inches. However, any length or height can be considered within the scope of this disclosure.

Figure 7:
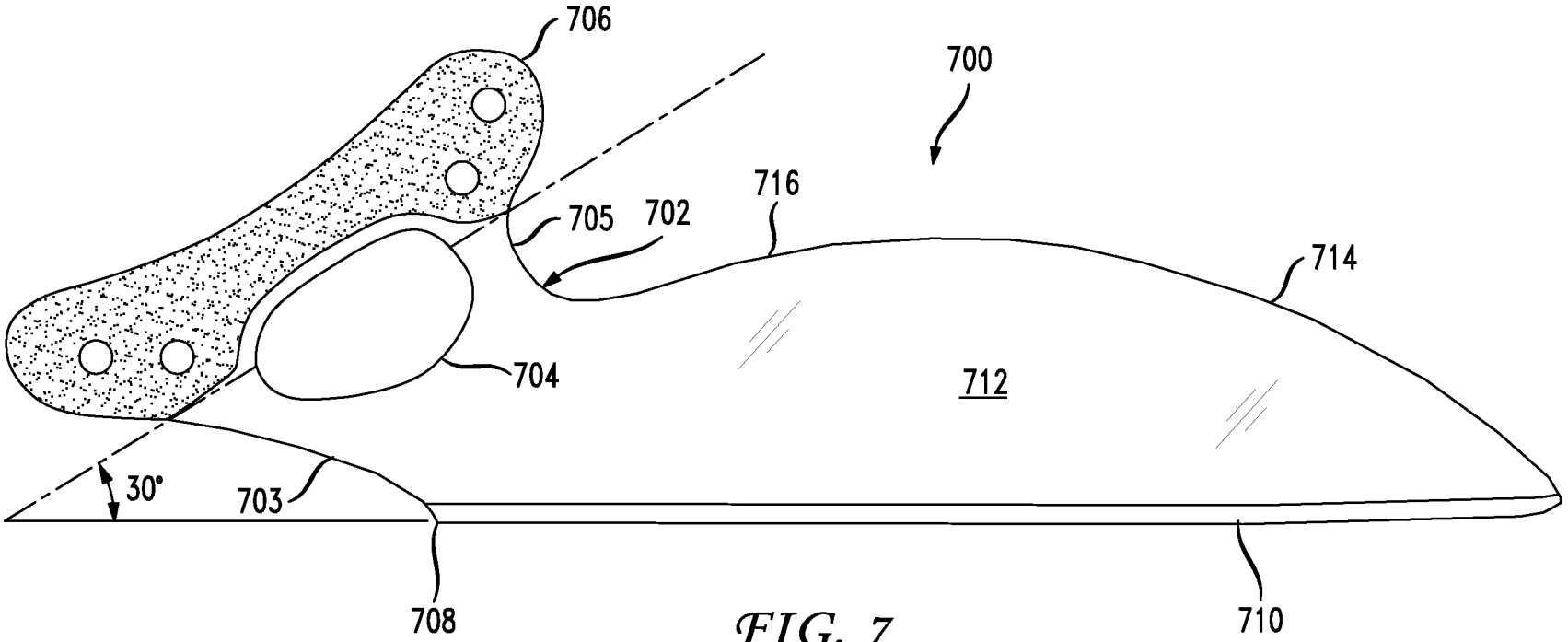
FIG. 7 illustrates a sixth embodiment of the disclosure.

FIG. 7 illustrates a sixth embodiment of this disclosure and illustrates a tool 700 having a member 712 with a first edge 714 and a second edge 716. Edge 710 is typically flat although it could be angled near the first edge 714 and is typically the sharpened edge of the member 712. At position 708 along an end of edge 710, the connecting member 702, which connects member 712 with the handle 706, has a surface 703 which defines a portion of the connecting member 702. The connecting member 702 also has an opening 704 and surface 705 which defines a structure of the connecting member 702.

It is noted in FIG. 7 that the connecting member 702 as it is configured fixedly connects the handle 706 to the member 712 such that the handle is shown at an angle of 30° relative to a line defined generally by edge 710. It is noted, however, that the connecting member 702 can be configured also to fix the angle of handle 706 at any angle between and including 25° and 45°.

It is generally considered that a preferable overall dimensions of tool 700 is between 12 and 14 inches long and between 3 and 5 inches tall. However, any length of the width and the height can be considered as within the scope of this disclosure.

Preferably the tools disclosed herein are knives, but the principles disclosed herein could also relate to saws or surgical tools of large or small size and thus the application can be broadly applied.

I claim:

1. A tool comprising:

a cutting blade having a sharp, smooth edge that is not curved along at least 50% of a distance of the sharp, smooth edge, a first end of the sharp, smooth edge, a second end of the sharp, smooth edge, and a top, corner surface of the cutting blade configured above the second end of the sharp, smooth edge, wherein the sharp, smooth edge is curved at the first end of the sharp, smooth edge, and is without teeth or serration; and a connecting member connecting the top, corner surface of the cutting blade with a bottom surface of a handle, the bottom surface of the handle and a top surface of the handle comprising a gripping portion for a user to grip the tool, wherein:

the cutting blade is only connected to the handle via the connecting member at the top, corner surface of the cutting blade and not via the first end of the sharp, smooth edge;

the connecting member connects the handle to the top, corner surface of the cutting blade such that a first plane that runs along a longitudinal axis of the bottom surface of the handle intersects a second plane that the sharp, smooth edge of the member is in at a fixed and unchangeable angle, the fixed and unchangeable angle being between 20° and 46°;

the connecting member and a metal portion of the handle are a monolithic structure made from a same piece of metal;

the handle extends beyond the second end of the sharp, smooth edge of the cutting blade and extends in a first direction relative to the connecting member and in a second direction relative to the connecting member, wherein the first direction and the second direction are in opposite directions from each other;

the connecting member does not have the sharp, smooth edge; and the connecting member generally extends from the top, corner surface of the cutting blade to the bottom surface of the handle at an angle between 125° and 170° relative to the second plane that the sharp, smooth edge of the cutting blade is in.

2. The tool of claim 1, wherein the tool is one of a knife and a surgical instrument.

3. The tool of claim 1, wherein the connecting member has a first edge that connects to the cutting blade more than 1.5 inches from a most extended position of the second end.

4. The tool of claim 3, wherein a second edge of the connecting member is positioned at a least extended position of the second end of the cutting blade.

5. The tool of claim 1, wherein the connecting member comprises an opening having a diameter of at least one inch.

6. The tool of claim 1, wherein the handle is at a 30° angle relative to the sharp, smooth edge.

7. The tool of claim 1, wherein the tool is between 10 and 13 inches wide and between 3 and 7 inches tall.

8. The tool of claim 1, wherein the handle has a first portion that extends in a first direction from the connecting member, the first portion being longer than an opposing second portion of the handle that protrudes in a second direction, which is in an opposite direction relative to the first direction, from the connecting member.

9. The tool of claim 1, wherein the connecting member connects the cutting blade to the handle at a central portion of the handle.

10. The tool of claim 1, wherein the sharp, smooth edge of the cutting blade comprises a straight edge.

11. The tool of claim 10, wherein the sharp, smooth edge of the cutting blade is straight for over half of a length of the member.

12. The tool of claim 10, further comprising a second edge on an opposite side of the cutting blade from the sharp, smooth edge, the second edge being rounded and not sharp.

13. The tool of claim 1, wherein the cutting blade is made from a solid material with no holes or openings contained therein.

* * * * *